United States Patent [19]

Müller et al.

[11] 4,350,184

[45] Sep. 21, 1982

[54] SHUTTLELESS WEAVING MACHINE

[76] Inventors: Jakob Müller, Kehristenstrasse 23, CH-6362 Stansstad, Switzerland; Ferdinand Diesner, Spittelweg 1, D-7887 Murg-Hänner, Fed. Rep. of Germany

[21] Appl. No.: 131,367

[22] Filed: Mar. 18, 1980

[30] Foreign Application Priority Data

Mar. 29, 1979 [CH] Switzerland ..... 2947/79

[51] Int. Cl.[3] ..... D03D 47/20

[52] U.S. Cl. ..... 139/448

[58] Field of Search ..... 139/444, 445, 447, 448

[56] References Cited

U.S. PATENT DOCUMENTS

| | | | |
|---|---|---|---|
| 2,072,161 | 3/1937 | Dewas | 139/448 |
| 3,384,126 | 5/1968 | Golobart | 139/448 |
| 3,578,031 | 5/1971 | Maassen | 139/448 |
| 3,719,211 | 3/1973 | Porter | 139/448 |

FOREIGN PATENT DOCUMENTS

| | | | |
|---|---|---|---|
| 48-29825 | 9/1973 | Japan | 139/448 |

*Primary Examiner*—Henry Jaudon

*Attorney, Agent, or Firm*—Michael J. Striker

[57] ABSTRACT

The shuttleless weaving machine contains a weft inserter of a weft yarn having a receiving slot oriented towards the direction of inserting of a weft yarn. The inserter is provided with a clamp for receiving and holding the weft yarn to be inserted. The weft yarn inserter is provided with at least one cutting device. In order to render the weaving machine more simple, safer in operation and also faster, a portion of the receiving slot and the clamp are arranged in a replaceable cartridge inserted into a tubular housing. The wall of the housing is provided with a further portion of the receiving slot, which is in alignment with the first mentioned portion. The so-formed receiving slot receives and grips the weft yarn supplied to the shed of the weaving machine from the yarn bobbin.

14 Claims, 10 Drawing Figures

SHUTTLELESS WEAVING MACHINE

BACKGROUND OF THE INVENTION

The invention relates to a shuttleless weaving machine.

Shuttleless weaving machines of the initially named type are known, for instance from the U.S. Des. No. 659,180.

In the known weaving machine, a weft inserter has a relatively large cross section, so that the shed must be opened relatively wide in order for the weft inserter to pass through. This will result in large, heavy and thus slow-moving drives and thus to limited output of the weaving machine. The weft inserter is, furthermore, of very complicated construction. Maintenance and repair require long downtimes, since the complete inserter must be replaced.

SUMMARY OF THE INVENTION

It is an object of the invention to design a shuttleless weaving machine of the initially named type in such a manner, that the weft inserter will be outstandingly simple, easily replaceable and furthermore of small size in order to allow using only a small opening of the weft shed.

As per invention, this object is achieved by a weaving machine comprising a warp shed, a reed, a cutting device, and an inserter, wherein the inserter is composed of two parts, such as a housing and a cartridge insertable into the housing which are formed with respective slots, these slots in assembly forming a slot for receiving and holding a weft yarn supplied to the inserter from a yarn supplying device.

By arranging the clamping device and a portion of the receiving slot within an exchangeable cartridge which is set within a tubular housing of the weft inserter, wherein the housing will still represent a portion of the slot, an inserter is obtained, which will facilitate maintenance and repairs since the cartridge may be exchanged extremely quickly and the weaving machine will have practically no downtimes therefor. Since the cartridge contains the clamping device and since the housing is the supporting component, the clamping device, and thus also the cartridge may be of very simple and small construction so that the weft inserter will have only a small cross section and will thus require only a limited opening of the warp shed. This will also allow that the drive of the weaving machine is kept small so that it will have only limited mass forces and may commensurately run at a higher speed which will result in higher outputs of the weaving machine.

The receiving slot of the weft inserter may be of a uniform width over its entire depth. This design is however of particular advantage since the wider inlet portion will enable secure gripping of the weft yarn whilst the portion which is tapering inward will ensure improved guiding and holding of the weft yarn.

The arcuate shape of the helical spring will open the spring windings to one side and thus allow a weft yarn to enter. The pull exerted when inserting the weft yarn will lead it to the side where the windings abut and clamp it there. The coil spring may be arranged in the direction of the weft inserter.

Designing the clamping device with clamps positioned in the receiving slot will, on one hand, enable stronger clamping, and yet an easier release when the inserter is moved in the opposite direction.

The cutting device may include a scissors-like design will ensure secure cutting of the weft yarn. The scissors blades may herein be pretensioned by spring force into a partially opened position, and an increased tension of the weft yarn upon continuing movement of the inserter will further actuate the scissors against the spring force of pretensioning and will cause cutting of the weft yarn. A more simple design of the cutting device may include a knife blade. In this construction however, the knife blade cannot be replaced together with the cartridge, and the edge of the housing slot, serving as cutting blade, must be reground.

It will be of advantage to design the weaving machine according to the invention so as to remove lint remaining in the weft yarn inserter, particularly in the clamping device.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
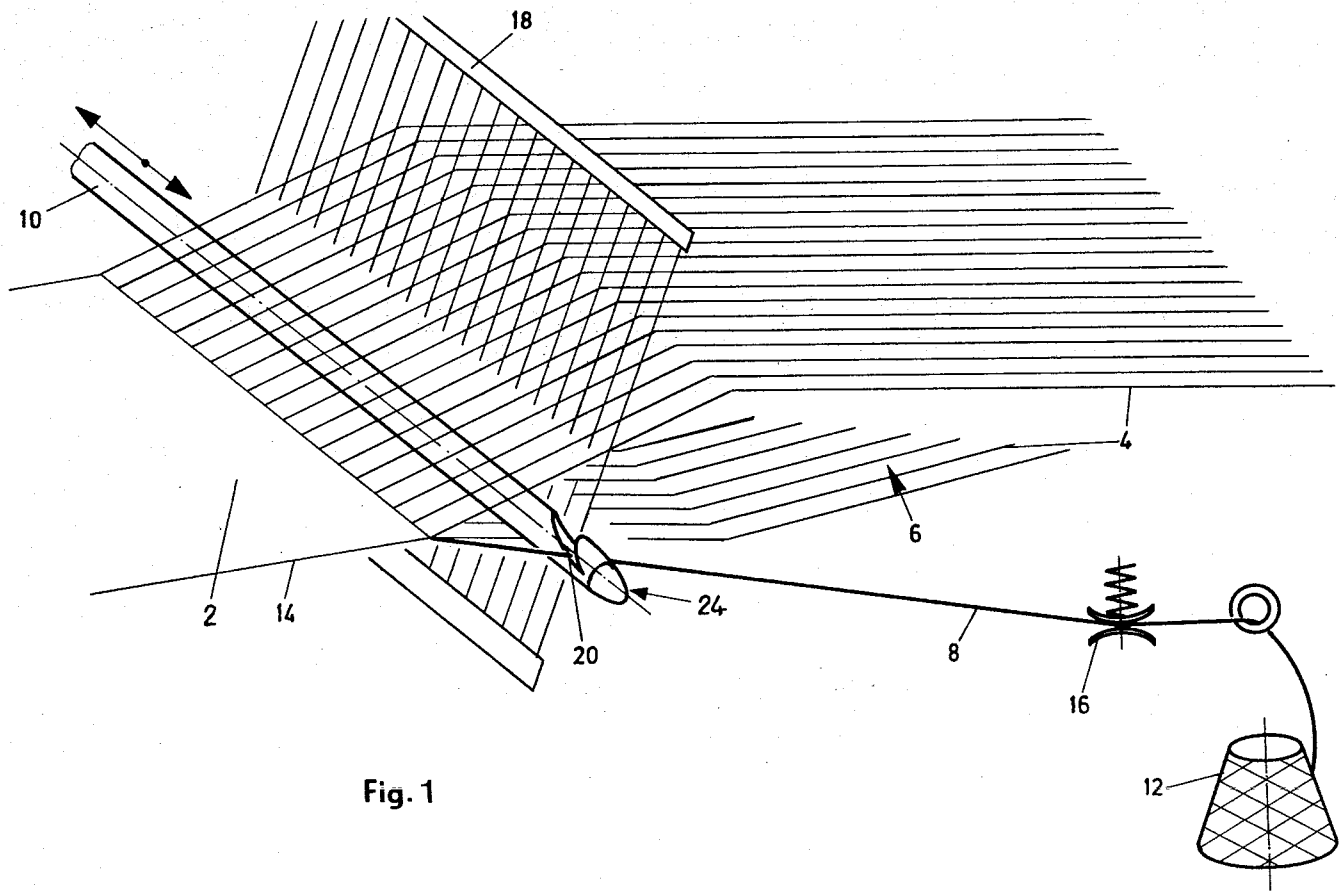
FIG. 1 is a schematic view showing the principle of producing a fabric on a weaving machine with inserter.

FIG. 1 shows a schematic of the production of a fabric 2, for instance, a tape fabric, from a warp yarn 4 opened into a shed 6 and from a weft yarn 8 which is inserted into the warp shed 6. The weft yarn 8 is unwound from a yarn bobbin 12 by means of the inserter 10, inserted from the lateral fabric edge 14 into the warp shed 6 and beaten up by the read 18.

Figures 2, 3, 4, 5, 6:
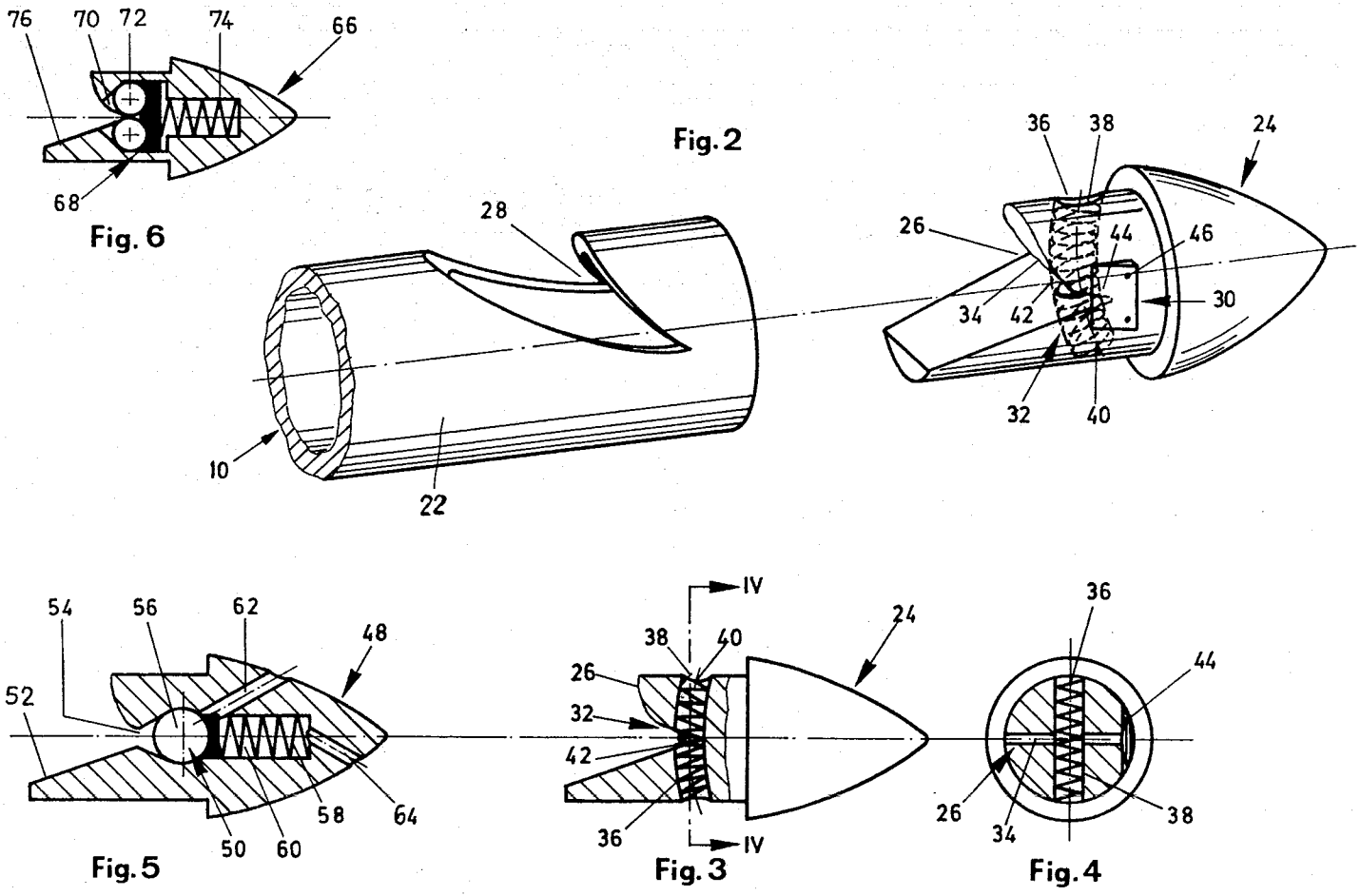
FIG. 2 is an exploded perspective view of the inserter of FIG. 1, consisting of housing and cartridge.
FIG. 3 is a side view, partially in section, of the cartridge of FIG. 2.
FIG. 4 illustrates the cartridge of FIG. 3 in section IV—IV.
FIG. 5 shows a further cartridge in longitudinal section.
FIG. 6 illustrates a still further embodiment of the longitudinal section.
Figure 7:
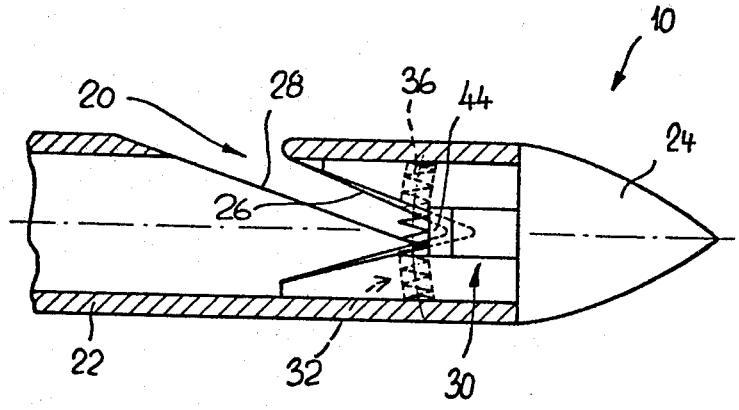
FIG. 7 is a sectional view through the inserter of FIG. 2, in assembly.
Figure 8:
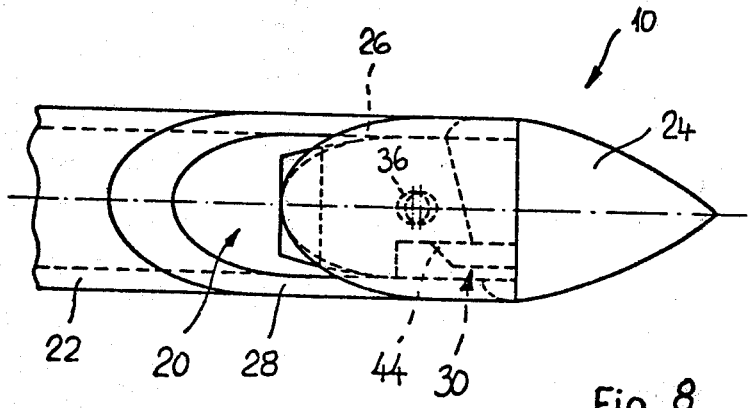
FIG. 8 is a plan view of FIG. 7.

As can be seen particularly also from FIGS. 2 to 4, the inserter 10 is provided with a receiving slot 20 illustrated also in FIGS. 7 and 8 and oriented contrary to the direction of inserting and serving to receive and guide the weft yarn 8. The weft yarn inserter 10 contains a tubular housing 22 with a cartridge 24 inserted at its end. The receiving slot 20 is formed by a cartridge slot 26 in the cartridge 24 and a housing slot 28 of the housing 22 when they are in assembly (as shown in FIG. 1). The cartridge slot 26 and the housing slot 28 are essentially in alignment and act conjointly. The cartridge 24 will have a cutting device 30 for the weft yarn 8 at least on its side not facing the reed 18. The inserter 10 contains furthermore a clamping device 32 for receiving and holding the weft yarn 8 which is to be inserted. The cartridge 24 is designed with a conical taper towards its tip.

The clamping device 32 contains a coil spring 36 arranged at the bottom of the receiving slot 20, set into an opening 38 of the cartridge 24. This arrangement is made in such a manner that the coil spring is located coaxially to an axis 40 transversal and arcuate towards the receiving slot 20. The windings 42 of the coil spring 36 will thereby be opened towards the receiving slot 20 and will allow the weft yarn 8 to enter. Since the windings 42 are tapering towards the side away from the receiving slot 20, they can hold a weft yarn in this direction, as evidenced by FIG. 3.

The cutting device 30 consists of a knife blade 44, arranged in the present instance in the cartridge 24 on that side of the weft yarn inserter 10 not facing the reed 18. The knife blade projects into the receiving slot 20 of the weft yarn inserter 10. Screws 46, not shown in detail, enable exchanging the knife blade.

Figure 9:
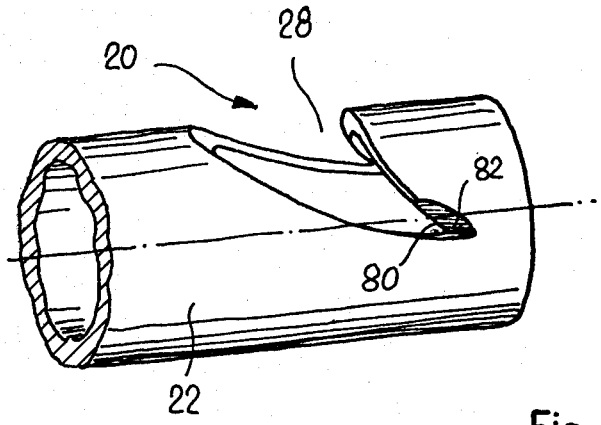
FIG. 9 is a partial view of the housing of the inserter with a slot having a cutting edge in accordance with the modification of the invention.
Figure 10:
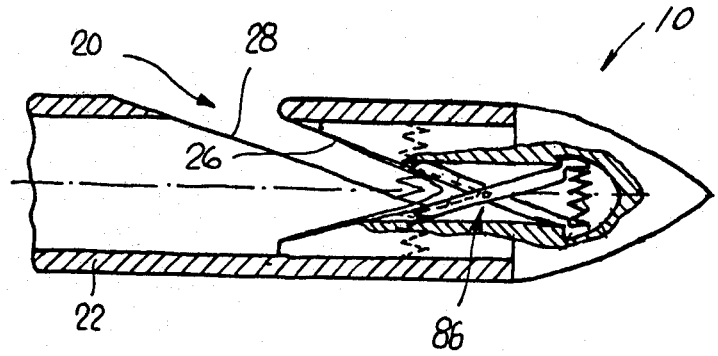
FIG. 10 is a sectional view through the inserter in accordance with another embodiment of the invention.

Contrary to the embodiment shown, the knife blade may also be arranged at the exterior of the housing. It is furthermore also possible to sharpen the housing slot 28 and to use it as knife blade 80, 82 as shown in FIG. 9. The cutting device can also be formed as scissors 86 as shown in FIG. 10.

FIG. 5 shows a further embodiment of a cartridge 48 with a modified clamping device 50. The latter is provided with a chamber 54 extending at the bottom of the receiving slot 52, and contains a clamp 56 pretensioned by means of a spring 58 towards the receiving slot 52. The clamp 56 is constructed as a rotational body, preferably a sphere. Lint removing passages, 62, 64 serving to remove the lint accruing during weaving, end, respectively, in the chamber 60 for holding the spring 58, as well as in the chamber 54 of the clamp 56. A weft yarn will reach the chamber 54 through the receiving slot 52 and will, with increasing tension displace the clamp 56, the yarn lodging in the gap between the clamp 56 and the chamber wall. The stronger the tension of the weft yarn becomes, the stronger it will clamp in the clamping device. The weft yarn will come free from the clamp 56 upon the weft yarn inserter moving in the opposite direction.

FIG. 6 shows a further embodiment of the cartridge 66, designed analogous to that of FIG. 5, the clamping device 68 however having now a somewhat larger chamber 70, provided with two clamps 72, pretensioned towards the receiving slot 76 by means of a spring 74. The clamps 72 will suitably again consist of rotational bodies, preferably cylinders or spheres, wherein the weft yarn to be inserted may clamp itself between the clamps 72. The clamps 72 will roll off on each other upon clamping as well as upon subsequent releasing.

Functioning of the shuttleless weaving machine is as follows:

The weft yarn inserter 10 will reach into the open warp shed 6 from the left-hand fabric edge of FIG. 1 and will grip the weft yarn 8 at the right-hand fabric edge 14, whereby the weft yarn will engage the receiving slot 20. The weft yarn inserter is thereupon moved to the left wherein it will on one hand unwind the weft yarn 8 from the bobbin 12 and, on the other hand pull taut the weft yarn already woven in. A weft yarn loop is formed initially herein and the weft yarn pressed into the clamp 32 by the increasing tension. The weft yarn will be cut off by the cutter 30 on its side away from the reed 18 as soon as that part of the weft yarn facing the fabric has reached a certain tension by the progressing motion of the weft yarn inserter 10. The severed leg of the weft yarn loop will remain in the warp shed. The other leg of the weft yarn 8 will remain clamped in the clamping device 32 of the weft yarn inserter 10 and is pulled by means of the weft yarn inserter 10 through the warp shed 6 and to the left hand side of the fabric. The warp shed 6 will now change and the reed 18 will beat up the inserted weft yarn 8. The weft yarn inserter will thereupon move again from left to right and insert the remaining portion of the preceding weft yarn into the new warp shed. The remaining portion is stretched thereby and the yarn tension thus achieved will draw the remaining portion of the weft yarn out of the clamp 32 so that it will be introduced into the warp shed. The weft yarn inserter 10 continues to move towards the right-hand side and can grip a new weft yarn 8 whereupon the insertion sequence described above will be repeated.

If the remaining portions of the weft yarn are not to be introduced into the warp shed, this may be prevented by simple means, for instance, by a tappet of a retainer preventing introduction of the remaining portion into the warp shed or retrieving this remaining portion. The same may be accomplished, for instance, by a stream of air.

The weft yarn inserter may be a weft bar as described above, it is however also possible to design the weft yarn inserter as a flexible tape or a flier with its active end constructed in a manner corresponding to the invention.

The above description has shown that the novel shuttleless weaving machine is of an outstandingly simple design and will allow high weaving speeds thereby, with the capacity of the weaving machine being further improved by limited time required for maintenance and repairs.

We claim:

1. In a shuttleless weaving machine in which successive sheds are formed in the warp, means supplying a weft yarn, a movable weft yarn inserter for inserting the weft yarn into the successive warp sheds, a reed, and a cutting device on said inserter, said inserter including a housing, a replaceable cartridge insertable therein, said cartridge including a clamping device for receiving and gripping the weft yarn to be inserted into said inserter, said housing being formed with a housing slot, said cartridge being formed with a cartridge slot, said housing slot being in alignment with said cartridge slot when said housing and said cartridge are in assembly so as to form a slot for receiving the weft yarn from said supplying means.

2. The machine of claim 1, wherein said receiving slot tapers towards the interior of said housing.

3. The machine of claim 2, wherein said clamping device is mounted at the end of said receiving slot and includes a helical spring.

4. The machine of claim 3, said spring being arcuate relative to said receiving slot and extending in coaxial alignment with an axis which is transversal to the elongation of said receiving slot.

5. The machine of claim 2, wherein said clamping device includes a chamber formed in said cartridge, at least one clamp mounted in said chamber, and a spring in said chamber, said clamp being pretensioned by said spring toward said receiving slot.

6. The machine of claim 5, wherein two adjacent clamps are mounted in said chamber and adapted to receive and clamp the weft yarn inserted therebetween.

7. The machine of claim 6, wherein said clamps are rotational bodies.

8. The machine of claim 7, wherein said bodies are spherical.

9. The machine of claim 5, wherein said at least one clamp is a rotational body.

10. The machine of claim 9, wherein said clamp is a spherical body.

11. The machine of claim 1, wherein said cutting device includes a scissors-like element, said element being interchangeable and opening in a direction of said receiving slot.

12. The machine of claim 1, wherein said cutting device includes a knife blade.

13. The machine of claim 12, wherein said housing slot has an edge formed as the knife blade.

14. The machine of claim 1, wherein said cartridge is formed with at least one lint removal passage extending from said clamping device.

* * * * *